US012420965B2

(12) United States Patent
Kim et al.

(10) Patent No.: US 12,420,965 B2
(45) Date of Patent: Sep. 23, 2025

(54) PACKAGING DEVICE FOR INDIVIDUAL POUCH-PACKAGED PAD-TYPE COSMETIC PRODUCT

(71) Applicant: TEXKOR CORPORATION, Gwangju-si (KR)

(72) Inventors: Sang Bum Kim, Icheon-si (KR); Chi Gu Lee, Seongnam-si (KR); Jong Gyu Gi, Gwangju-si (KR); Jun Young Jang, Gwangju-si (KR)

(73) Assignee: TEXKOR CORPORATION, Gwangju-si (KR)

( * ) Notice: Subject to any disclaimer, the term of this patent is extended or adjusted under 35 U.S.C. 154(b) by 0 days.

(21) Appl. No.: 18/415,391

(22) Filed: Jan. 17, 2024

(65) Prior Publication Data

US 2025/0026514 A1 Jan. 23, 2025

(30) Foreign Application Priority Data

Jul. 17, 2023 (KR) ..... 10-2023-0092694
Jul. 17, 2023 (KR) ..... 10-2023-0092695
Jul. 17, 2023 (KR) ..... 10-2023-0092696

(51) Int. Cl.
*B65B 11/50* (2006.01)
*A45D 44/00* (2006.01)
*B65B 41/16* (2006.01)

(52) U.S. Cl.
CPC ..... *B65B 11/50* (2013.01); *A45D 44/00* (2013.01); *B65B 41/16* (2013.01)

(58) Field of Classification Search
CPC ..... B65B 11/50
See application file for complete search history.

(56) References Cited

U.S. PATENT DOCUMENTS 2,958,437 A * 11/1960 Mengis ..... B31B 70/8122 493/220
3,140,572 A * 7/1964 Petersen ..... B65B 9/02 53/553
3,611,671 A * 10/1971 Skinner et al. ..... B21J 15/34 53/553
3,910,410 A * 10/1975 Shaw ..... B65D 75/26 206/564

(Continued)

FOREIGN PATENT DOCUMENTS

KR 10-1470134 B1 12/2014

*Primary Examiner* — Gloria R Weeks
(74) *Attorney, Agent, or Firm* — Bridgeway IP Law Group, PLLC; Sang Ho Lee; Hyun Woo Shin

(57) ABSTRACT

A packaging device for an individual pouch-packaged pad-type cosmetic product is proposed. First and second guide rollers gripping a longitudinally cut cosmetic cotton fabric from opposite sides and supply it at a constant speed are connected to each other through a second rotational interlock device to be rotated equally, so that the cosmetic cotton fabric can be supplied constant by a preset length. Among the first and second guide rollers, the second guide roller is fixed but the first guide roller is moved with pressure of a second elastic pressure member, so that the cosmetic cotton fabric can be stably supplied by a predetermined length while variably responding to the thickness thereof. A rotation suction part sucks cut pouches and then is rotated to place and align the pouches in correct positions on a transport conveyor, so that the final produced pouches are aligned to reduce a packaging time.

8 Claims, 6 Drawing Sheets

(56) References Cited

U.S. PATENT DOCUMENTS 4,244,158 A * 1/1981 Nelham ..... B29C 66/849 53/550
4,410,089 A * 10/1983 Bortolani ..... B65D 75/5855 383/211
4,565,047 A * 1/1986 Nishikawa ..... B65B 51/06 53/562
4,609,556 A * 9/1986 Goedert ..... B65B 9/042 206/0.5
4,676,051 A * 6/1987 Hoskinson ..... B65B 61/12 53/562
4,730,439 A * 3/1988 Chung ..... B65B 1/02 53/511
4,779,400 A * 10/1988 Hoskinson ..... B29C 66/8432 53/562
4,829,742 A * 5/1989 Romagnoli ..... B65B 29/04 156/553
4,885,896 A * 12/1989 Romagnoli ..... B65B 61/24 53/134.2
4,961,302 A * 10/1990 Davis ..... B29C 66/7373 53/554
4,985,106 A * 1/1991 Nelson ..... B32B 3/02 156/227
5,345,750 A * 9/1994 Gries ..... B65B 35/26 53/553
5,740,661 A * 4/1998 Yamaguchi ..... B65B 9/02 53/553
6,122,894 A * 9/2000 Romagnoli ..... B65B 9/02 53/64
6,199,349 B1 * 3/2001 Lerner ..... B65B 55/20 53/472
6,350,339 B1 * 2/2002 Sessions ..... A61F 13/023 53/553
6,655,112 B1 * 12/2003 Cremer ..... B65B 9/02 156/247
6,666,004 B2 * 12/2003 Hilbert, Sr. ..... B65B 9/02 53/553
8,056,455 B2 * 11/2011 Beaudry ..... B26D 5/32 83/13
8,201,386 B2 * 6/2012 Oba ..... B65D 85/07 53/429
8,758,547 B2 * 6/2014 Popp ..... B32B 37/1292 604/389
2005/0127554 A1 * 6/2005 Smith ..... B26D 7/10 425/297
2005/0198931 A1 * 9/2005 Cesiro ..... A61F 13/15747 53/461
2009/0118658 A1 * 5/2009 Tarinelli ..... A61F 13/38 604/289
2010/0272938 A1 * 10/2010 Mitchell ..... D04H 1/43835 428/36.1
2012/0090282 A1 * 4/2012 Tsumura ..... B65B 51/16 53/523
2014/0216975 A1 * 8/2014 Chrysanthidis ..... B65D 79/00 206/524.6

* cited by examiner

PACKAGING DEVICE FOR INDIVIDUAL POUCH-PACKAGED PAD-TYPE COSMETIC PRODUCT

CROSS REFERENCE TO RELATED APPLICATIONS

The present application claims priority to Korean Patent Applications No. 10-2023-0092694, filed Jul. 17, 2023, No. 10-2023-0092695, filed Jul. 17, 2023 and No. 10-2023-0092696, filed Jul. 17, 2023, the entire contents of which are incorporated herein for all purposes by reference.

BACKGROUND

1. Technical Field

The present disclosure relates to a packaging device for an individual pouch-packaged pad-type cosmetic product. More particularly, the present disclosure relates to a packaging device for a pad-type cosmetic product individually packaged in a pouch, wherein a first guide roller and a second guide roller, which grip a longitudinally cut cosmetic cotton fabric from the opposite sides and supply the cosmetic cotton fabric at a constant speed, are connected to each other through a second rotational interlock device to be rotated equally, so that the cosmetic cotton fabric can be supplied constant by a preset length, and furthermore, among the first guide roller and the second guide roller gripping the longitudinally cut cosmetic cotton fabric from the opposite sides, the second guide roller is fixed but the first guide roller has a structure that is moved while being pressurized by a separate second elastic pressure member, so that the longitudinally cut cosmetic cotton fabric can be stably supplied by a specific length while variably responding to the thickness of the transported longitudinally cut cosmetic cotton fabric, and furthermore, a rotation suction part sucks cut pouches and then is rotated to place and align the pouches in correct positions on a transport conveyor, so that the final produced pouches are aligned in the correct positions on the transport conveyor to reduce a packaging time.

2. Description of the Related Art

General cosmetic cotton pad mainly uses 100% pure cotton non-woven fabric, and square cosmetic cotton pad is manufactured by cutting the pure cotton non-woven fabric in a longitudinal direction and then cutting the fabric in a transverse direction for a certain length of a cosmetic cotton pad. The cosmetic cotton pad manufactured in the above-described way is usually released as a product in a dried state, and users moisten the dry cosmetic cotton pad with facial lotions such as cleansing water, toner, essence, etc. and to wipe the skin, or apply the cosmetic product on the skin or be used as a pack on the skin. However, when using the cosmetic cotton pad outside rather than inside a home or office, it is actually cumbersome and inconvenient to carry the cosmetic cotton pad and facial lotion one by one and apply the facial lotion to the cosmetic cotton pad. Therefore, in recent years, the number of commercialization of cosmetic cotton pads produced by soaking a certain number of cosmetic cotton pads in various liquid lotions at once and then packaging them in cylindrical containers is growing, rather than dry cosmetic cotton pads. Even when using the multiple soaked cosmetic cotton pads in a cylindrical container, it is also inconvenient to carry the container, and when using it, when the user opens a lid of the container and remove the wet thin pad by hand, remaining pads will be contaminated by the customer's hand and are not hygienic, and sometimes, when the lid is left open, the remaining pads dry out and become unusable, which is a problem.

To make up for the shortcoming of the cylindrical container packaged pad type cosmetics, the cosmetics can be improved with individual pouch-packaged pad-type cosmetics. However, each cut cosmetic cotton fabric pad must be precisely located within a packaging film and continuous process (packaging film vertical cutting, horizontal attachment, facial lotion filling, horizontal attachment, pouch vertical cutting, horizontal cutting) must be carried out in that state. It is difficult to precisely locate the cosmetic cotton fabric pad within the slippery packaging film, which is made of polyolefin resin (mainly, LLDPE or LDPE) to ensure good thermal adhesion, and to improve the stability of the packaging film process.

(Patent Document 1) Korean Patent No. 10-1470134 (date of registration: 5 Dec. 2014) "Rotary Cutting Type Manufacturing and Packaging Apparatus for Makeup Cotton"

The related art disclosed in the above patent document also relates to a device for manufacturing and packaging continuous cosmetic cotton pad, but in the packaging of cosmetic cotton pads, the related art merely presents the concept of applying a bundled packaging method by combining more than a number of stacked cosmetic cotton pad into one bundle, rather than a method of individually packaging each cosmetic cotton pad within a packaging film.

Therefore, a need for a packaging device structure is increasing, the packaging device structure being capable of the stability of processes, specifically, a process of supplying a longitudinally cut cosmetic cotton fabric consistently by a preset length or a process of individually packaging the cut cosmetic cotton fabric pad, and of placing and aligning the individually packaged pouch in place on a transport conveyor and automatically counting the number of pouches.

SUMMARY

The present invention has been made keeping in mind the above problems occurring in the related art, and the present disclosure is intended to provide a packaging device for an individual pouch-packaged pad-type cosmetic product, the packaging device being capable of supplying a cosmetic cotton fabric by a preset length consistently by connecting a first guide roller to a second guide roller through a second rotational interlock device, which grip a longitudinally cut cosmetic cotton fabric from the opposite sides and supply the cosmetic cotton fabric at a constant speed, to allow the first guide roller and the second guide roller to be rotated equally.

Another objective of the present disclosure is to provide a packaging device for an individual pouch-packaged pad-type cosmetic product, the packaging device being capable of variably responding to the thickness of a transported longitudinally cut cosmetic cotton fabric and stably supplying the longitudinally cut cosmetic cotton fabric by a constant length by a structure in which, among a first guide roller and a second guide roller gripping a longitudinally cut cosmetic cotton fabric from the opposite sides, the second guide roller is fixed but the first guide roller is moved while being pressurized by a separate second elastic pressure member.

Yet another objective of the present disclosure is to provide a packaging device for an individual pouch-packaged pad-type cosmetic product, the packaging device being capable of preventing a cosmetic cotton fabric pad from being not inserted into a packaging film or being crookedly inserted, by a structure in which the packaging film containing a cut cosmetic cotton fabric pad (or to be cut) does not directly grip the cosmetic cotton fabric pad and the cosmetic cotton fabric pad is gripped by separate fabric pad supply rollers located at front of the packaging film and then is supplied into the packaging film.

Still another objective of the present disclosure is to provide a packaging device for an individual pouch-packaged pad-type cosmetic product, the packaging device being capable of variably responding to the thickness of a supplied cosmetic cotton fabric pad and variably adjusting an elastic force according to use environment and stably performing a packaging film process, by a structure in which, in a pair of the fabric pad supply rollers and a pair of packaging film supply rollers, one roller is fixed the other roller is pressurized by a separate elastic pressure member (and elastic adjustment means).

Still another objective of the present disclosure is to provide a packaging device for an individual pouch-packaged pad-type cosmetic product, the packaging device being capable of aligning a final produced pouch in a correct position on a transport conveyor to reduce the packaging time, by a structure in which a rotation suction part sucks a cut pouch and then is rotated to place and align the pouch in a correct position on the transport conveyor.

Still another objective of the present disclosure is to provide a packaging device for an individual pouch-packaged pad-type cosmetic product, the packaging device being capable of improving the efficiency of a transport process for a large quantity of pouches, by application of a structure of generating vacuum required for suction integrally to a plurality of suction pads that suck and grip multiple cut pouches and moving the plurality of suction pads forwards and rearwards and rotating it at a time.

Still another objective of the present disclosure is to provide a packaging device for an individual pouch-packaged pad-type cosmetic product, the packaging device being capable of variably controlling a stacking form of pouches stacked on a transport conveyor and precisely counting the number of the pouches, by a counting module counting the number of the pouches stacked on the transport conveyor by the plurality of rotated suction pads, a rotation interval control module controlling rotation intervals of the plurality of rotated suction pads, and a transport speed control module controlling a transport speed of the transport conveyor moved in one direction.

In order to achieve the above-described objective, the present disclosure is realized by embodiments that has the following configuration.

According to an embodiment of the present disclosure, there is provided a packaging device for an individual pouch-packaged pad-type cosmetic product, and the packaging device includes: a cosmetic cotton supply unit supplying a cosmetic cotton pad to be contained within a packaging film; a packaging film supply unit supplying a packaging film to package a cut cosmetic cotton fabric pad; and a pouch alignment unit placing and aligning a cut pouch in a correct position thereof on a transport conveyor, wherein the cosmetic cotton supply unit may include a cosmetic cotton fabric guide roller supplying a longitudinally cut cosmetic cotton fabric by a predetermined length, and the cosmetic cotton fabric guide roller may include a first guide roller and a second guide roller, which grip the longitudinal cut cosmetic cotton fabric from the opposite sides and supply the cosmetic cotton fabric by the predetermined length.

According to another embodiment of present disclosure, the second guide roller may be connected to a separate driving part to be rotated at a predetermined rotation speed, and the first guide roller may be connected to the second guide roller through a second rotational interlock device, and the first guide roller may be operated in conjunction with the rotation speed of the second guide roller to be rotated equally to enable the longitudinally cut cosmetic cotton fabric transported to be supplied at a precise speed.

According to another embodiment of present disclosure, the second guide roller may be fixed, but the first guide roller may have a structure that is moved while being pressurized by a separate second elastic pressure member, thereby stably supplying the longitudinally cut cosmetic cotton fabric by the predetermined length while variably responding to a thickness of the longitudinally cut cosmetic cotton fabric transported.

According to another embodiment of present disclosure, the packaging film supply unit may include a pair of packaging film supply rollers supplying a pair of packaging films from the opposite sides to package the cut cosmetic cotton fabric pad at the opposite surfaces thereof, and a pair of fabric pad supply rollers gripping the cosmetic cotton fabric pad from the opposite sides thereof cut at front of the pair of packaging film supply rollers and supplying the cut cosmetic cotton fabric pad into the pair of packaging films.

According to another embodiment of present disclosure, the pair of packaging film supply rollers may be rotated in conjunction with a supply speed of the pair of packaging films supplied, and the pair of packaging film supply rollers and the pair of fabric pad supply rollers located at front of the pair of packaging film supply rollers may be connected to each other by a rotational interlock device, and the pair of fabric pad supply rollers may be rotated equally in conjunction with a rotation speed of the pair of packaging film supply rollers to supply the supplied cosmetic cotton fabric pad into the packaging films at a precise speed.

According to another embodiment of present disclosure, the pair of fabric pad supply rollers and the pair of packaging film supply rollers may have structures, in which one roller may be fixed but the other roller may be pressurized by a separate elastic pressure member, thereby stably performing a packaging film process while variably responding to a thickness of the cosmetic cotton fabric pad supplied.

According to another embodiment of present disclosure, the packaging film supply unit may further include press guide rollers gripping and aligning a pouch pile before the pouch pile with the cut cosmetic cotton fabric pad being arranged within the packaging films is cut, and each of the press guide rollers may have a separate rubber coating layer formed on an external circumferential surface thereof to stably grip and align the pouch pile.

According to another embodiment of present disclosure, the pouch alignment unit may include a rotation suction part sucking the cut pouch and then rotated to place and align the pouch in correct position thereof on the transport conveyor, and a suction guide part allowing the rotation suction part to suck the pouch easily.

According to another embodiment of present disclosure, the rotation suction part may include a plurality of suction pads respectively sucking and gripping a plurality of cut pouches, a vacuum generator generating vacuum required for suction of the respective suction pads, a suction pad driving part moving the plurality of suction pads forwards and rearwards, a rotation shaft allowing the plurality of suction pads to be rotated between the suction guide part and the transport conveyor, and a control part controlling the plurality of rotated suction pads to be located in precise positions thereof.

According to another embodiment of present disclosure, the control part may include a counting module counting the number of pouches stacked on the transport conveyor through the plurality of rotated suction pads, a rotation interval control module controlling rotation intervals between the plurality of rotated suction pads, and a transport speed control module controlling a transport speed of the transport conveyor moved in one direction, thereby variably controlling a stacking form of the pouches stacked on the transport conveyor and precisely counting the number of the pouches.

The present disclosure can have the following effects by the above-described embodiment, and configuration, connection, use relationship to be described below.

The present disclosure is intended to provide a packaging device for an individual pouch-packaged pad-type cosmetic product, the packaging device being capable of supplying a cosmetic cotton fabric by a preset length consistently by connecting a first guide roller to a second guide roller through a second rotational interlock device, which grip a longitudinally cut cosmetic cotton fabric from the opposite sides and supply the cosmetic cotton fabric at a constant speed, to allow the first guide roller and the second guide roller to be rotated equally.

Among a first guide roller and a second guide roller gripping a longitudinally cut cosmetic cotton fabric from the opposite sides, the second guide roller is fixed but the first guide roller is moved while being pressurized by a separate second elastic pressure member, so that the packaging device has the effect that can variably respond to the thickness of the transported longitudinally cut cosmetic cotton fabric and stably supplying the longitudinally cut cosmetic cotton fabric by a constant length.

The packaging film containing a cut cosmetic cotton fabric pad (or to be cut) does not directly grip the cosmetic cotton fabric pad and the cosmetic cotton fabric pad is gripped by separate fabric pad supply rollers located at front of the packaging film and then is supplied into the packaging film, so that the packaging device has the effect that can prevent a cosmetic cotton fabric pad from being not inserted into a packaging film or being crookedly inserted.

In a pair of the fabric pad supply rollers and a pair of packaging film supply rollers, one roller is fixed the other roller is pressurized by a separate elastic pressure member (and elastic adjustment means), so that the packaging device has the effect that can variably respond to the thickness of a supplied cosmetic cotton fabric pad and variably adjust an elastic force according to use environment and stably perform a packaging film process.

A rotation suction part sucks a cut pouch and then is rotated to place and align the pouch in a correct position on a transport conveyor, so that the packaging device has the effect that can align a final produced pouch in a correct position on the transport conveyor to reduce the packaging time.

The present disclosure uses a structure of generating vacuum required for suction to a plurality of suction pads that suck and grip multiple cut pouches and moving the plurality of suction pads forwards and rearwards and rotating it at a time, so that the packaging device has the effect that can improve the efficiency of a transport process for a large quantity of pouches.

The present disclosure uses a counting module counting the number of the pouches stacked on the transport conveyor by the plurality of rotated suction pads, a rotation interval control module controlling rotation intervals of the plurality of rotated suction pads, and a transport speed control module controlling a transport speed of the transport conveyor moved in one direction, so that the packaging device has the effect that can variably control a stacking form of pouches stacked on a transport conveyor and precisely count the number of the pouches.

DETAILED DESCRIPTION

Figure 1:
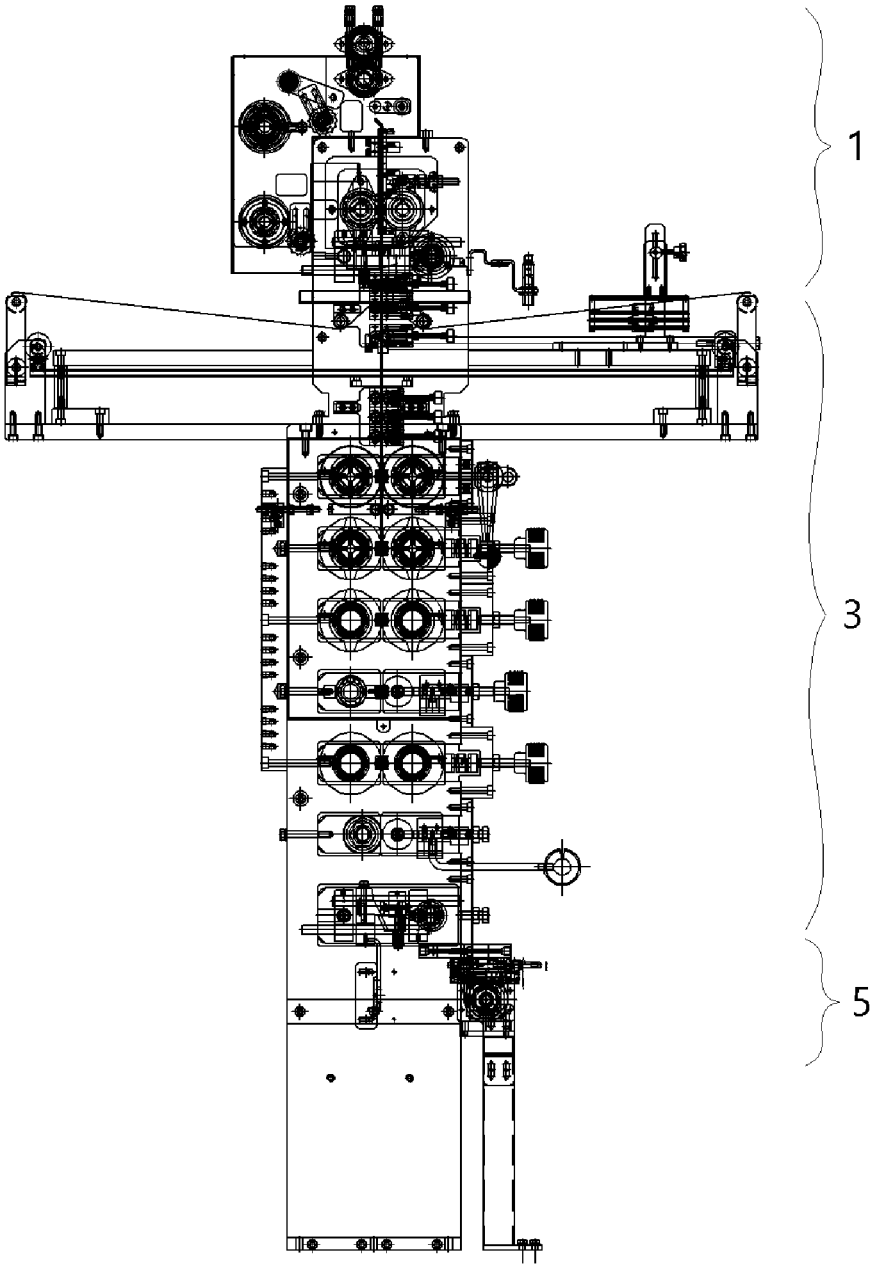
FIG. 1 is a side view schematically showing a packaging device of the present disclosure.
Figure 2:
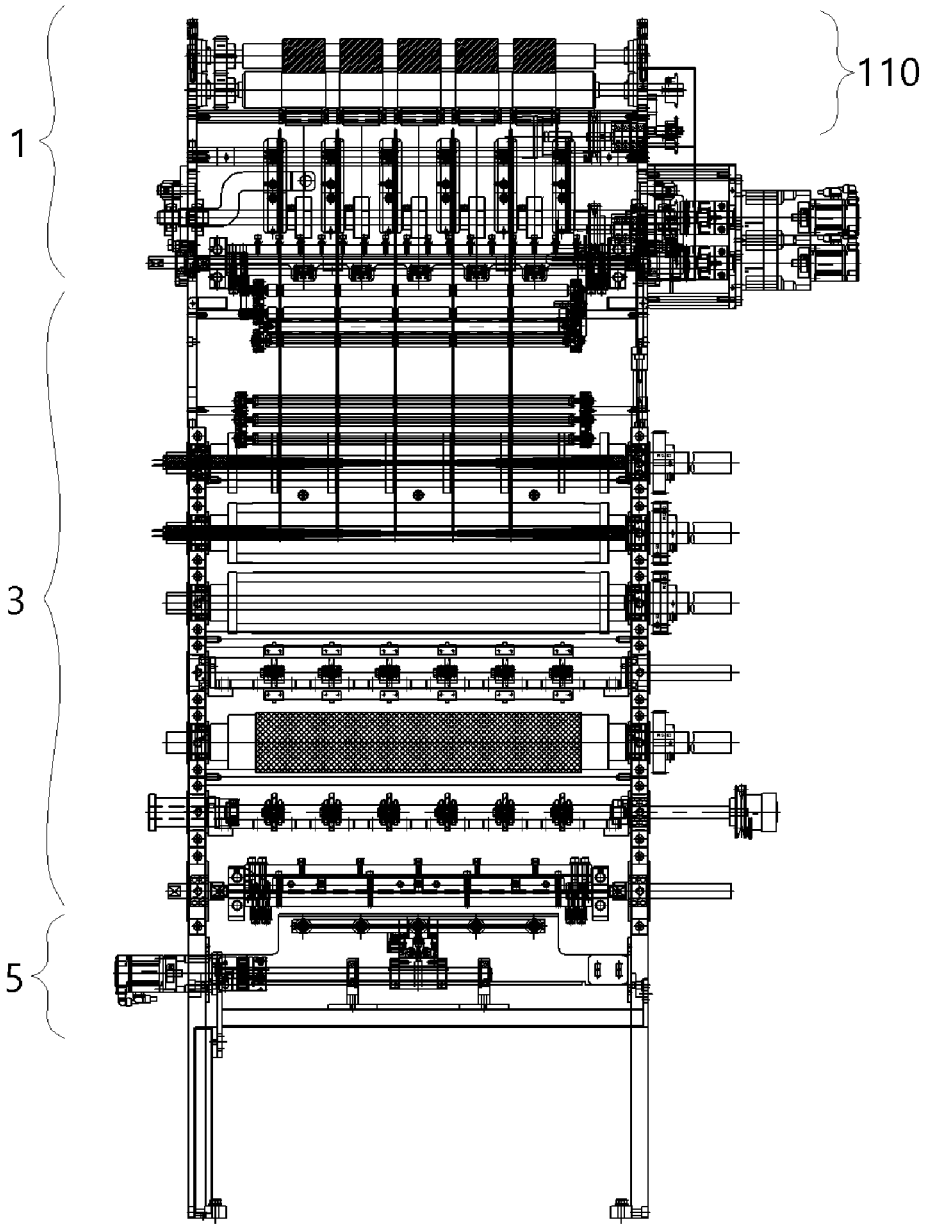
FIG. 2 is a front view schematically showing the packaging device of the present disclosure.

Hereinbelow, a packaging device for an individual pouch-packaged pad-type cosmetic product according to preferred embodiments of the present disclosure with improved stability of a cosmetic cotton fabric pad process will be described in detail with reference to accompanying drawings. The same reference numerals throughout the drawings denote elements having the same or similar function. Unless otherwise defined, all terms including technical and scientific terms used herein have the same meaning as commonly understood by one of ordinary skill in the art to which this invention belongs. When terms used herein discord from the commonly understood meaning, the terms will be interpreted as defined herein. Unless the context clearly indicates otherwise, it will be further understood that the terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof. Also, the terms "part", "module", and the like mean a unit for processing at least one function or operation and may be implemented by a combination of hardware and/or software.

Referring to FIGS. 1 to 4, according to the embodiment of the present disclosure, a packaging device for an individual pouch-packaged pad-type cosmetic product with improved stability in a cosmetic cotton fabric pad process may include: a cosmetic cotton supply unit 1 supplying a cosmetic cotton pad to be contained within a packaging film; a packaging film supply unit 3 supplying a packaging film to package a cut cosmetic cotton fabric pad; and a pouch alignment unit 5 putting and aligning a cut pouch in a correct position thereof on the transport conveyor.

First, in describing briefly a process in which the cosmetic cotton fabric pad is contained within the packaging film and a pouch (which means a product type in which each cosmetic cotton fabric pad is individually packaged by the packaging film and is not shown in the drawings) is manufactured, cosmetic cotton fabric pads (which mean pad type cosmetic cotton pads cut into a predetermined (width/length) size from a cosmetic cotton fabric), the cosmetic cotton fabric pads being cut in a predetermined unit size, are contained in a pair of original packaging films forming a front/rear surface at predetermined intervals, and opposite length parts of the packaging films and lower width parts of the packaging film are sealed along the circumferences of the cosmetic cotton fabric pads. Thereafter, liquid products fit for purposes (as an example, cleansing water liquid, skin softener/toner, lotion, cosmetic essence, etc.) are injected therein, and then upper width parts of the packaging films are sealed, and longitudinal cutting and transverse cutting are performed for the packaging films having the entirely original plate form, so that individual pouches each having one cosmetic cotton fabric pad contained within the packaging films are manufactured.

To this end, the cosmetic cotton supply unit 1 is a component serving to supply/seal/cut a cosmetic cotton fabric (normally, the cosmetic cotton fabric with the original form is supplied while being unrolled from a roll-shaped wound state, which is not shown in the drawings) to manufacture and supply cosmetic cotton fabric pads to be individually packaged. The packaging film supply unit 3 is a component serving to supply/seal/cut packaging films for packaging the respective cut cosmetic cotton fabric pads to manufacture and supply individual pouches. The pouch alignment unit 5 is a component serving to put and align the cut pouches in correct positions on the transport conveyor.

To briefly describe the process of progress for each component, first, the cosmetic cotton supply unit 1 may include: a cosmetic cotton fabric supply part supplying a cosmetic cotton fabric with the roll-shaped wound original form (at this point, the supplied cosmetic cotton fabric may have single layer, and a cosmetic cotton fabric having a double layer or a triple or more layer may be used); a plurality of cosmetic cotton fabric guide rollers guiding transport of the cosmetic cotton fabric unrolled from the roll shape; a cosmetic cotton pad longitudinal cutting part performing longitudinal cutting (direction coincident with the transport direction) for the cosmetic cotton fabric supplied with the original form by a predetermined interval (normally, an interval of the width of the cosmetic cotton fabric pad); guide rollers transporting the cosmetic cotton fabric longitudinally cut and guide the cosmetic cotton fabric to a cosmetic cotton pad transverse cutting part; and the cosmetic cotton pad transverse cutting part performing transverse cutting for the cosmetic cotton fabric longitudinally cut by a predetermined interval (normally, an interval of the length of each cosmetic cotton fabric pad) to form cosmetic cotton fabric pads having a predetermined unit size.

The packaging film supply unit 3 is a component, at a different location from the cosmetic cotton supply unit, supplying/sealing/cutting the packaging films to contain and package the cosmetic cotton fabric pads (cut) manufactured in the predetermined unit size, and the packaging film supply unit 3 may include: a pair of packaging film fabric supply parts supplying the roll-shaped wound packaging films in the original state from the opposite sides respectively (the packaging films are supplied from the opposite sides respectively to package the opposite surfaces of the cut cosmetic cotton fabric pads); a pair of packaging film supply transport rollers supplying/transporting the pair of packaging films from the opposite sides to allow the cut cosmetic cotton fabric pads to be contained between the pair of packaging films; a packaging film sealing part sealing circumferential surfaces of the packaging films along the circumferences of the cosmetic cotton fabric pads while the unit cosmetic cotton fabric pads are contained within the packaging films; a liquid product supply part injecting a liquid product into the pair of packaging films that is sealed in a pack shape; and a packaging film cutting part cutting longitudinally and transversely the original-shaped packaging film in a sealed state with the liquid product injected to manufacture individual pouches in which one cosmetic cotton fabric pad is contained within the packaging films (which includes a packaging film longitudinal cutting part and a packaging film transverse cutting part).

The pouch alignment unit 5 is a component to solve a conventional problem in that manufactured individual pouches fall onto the transport conveyor to be disorderedly arranged and transported on the transport conveyor. The pouch alignment unit 5 is a component serving to put and align the cut pouches on the transport conveyor in the correct positions.

Figure 3:
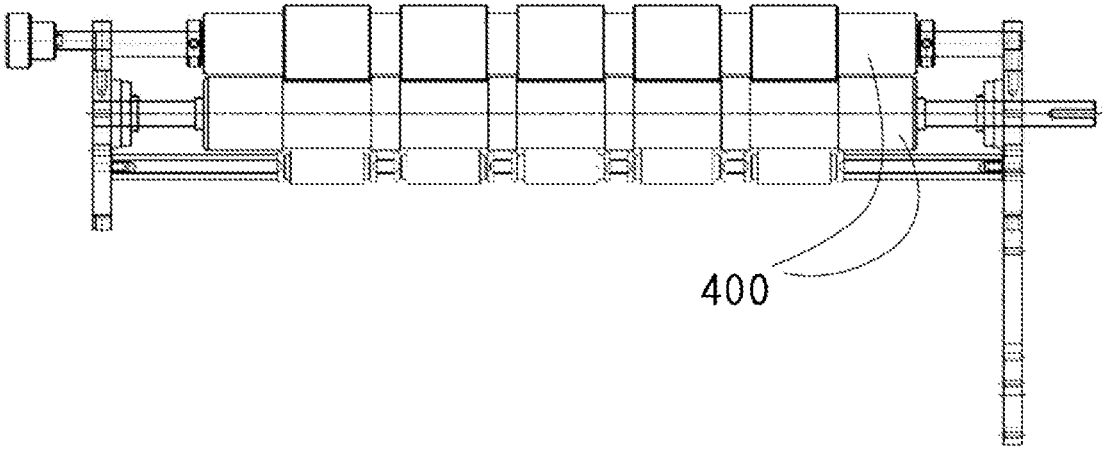
FIG. 3 is a structure view showing a conventional guide roller.

Meanwhile, in the present disclosure, specifically, a problem generated from the cosmetic cotton supply unit 1 may occur, in other words, after longitudinally (direction equal to a transport direction) cutting the cosmetic cotton fabric supplied in the original form by a predetermined interval (normally, an interval of the width of the cosmetic cotton fabric pad), in a process of transporting the cosmetic cotton fabric and guiding (supplying) the cosmetic cotton fabric to the cosmetic cotton pad transverse cutting part, as shown in FIG. 3, the existing structure is configured such that while the longitudinally cut cosmetic cotton fabric is located between the pair of the guide rollers 400, the longitudinally cut cosmetic cotton fabric is transported and supplied through the pair of guide rollers 400 simply arranged in parallel to each other. In this existing structure, when the cosmetic cotton fabric that always has a constant thickness is supplied no major problems may occur, but the cosmetic cotton fabric has difficulty with ensuring a normally uniform thickness throughout the entire fabric, and specifically, when one cosmetic cotton fabric ends and another cosmetic cotton fabric is successively transported (normally, in this case, the thickness of a portion where the respective fabrics are connected to each other doubles), there is a problem in that efficient transporting and supplying of the cosmetic cotton fabric is not performed in the existing structure, and the present disclosure focuses on improvement of the problem, which will be described in detail below.

As described above, in order to solve the problem occurring from the configuration of the existing pair of the guide rollers 400 that transport the longitudinally cut cosmetic cotton fabric and supply the longitudinally cut cosmetic cotton fabric to the cosmetic cotton pad transverse cutting part, the present disclosure uses and proposes a new structure that can actively respond to variable thickness change, etc. of the cosmetic cotton fabric, the target to be supplied.

Figure 4:
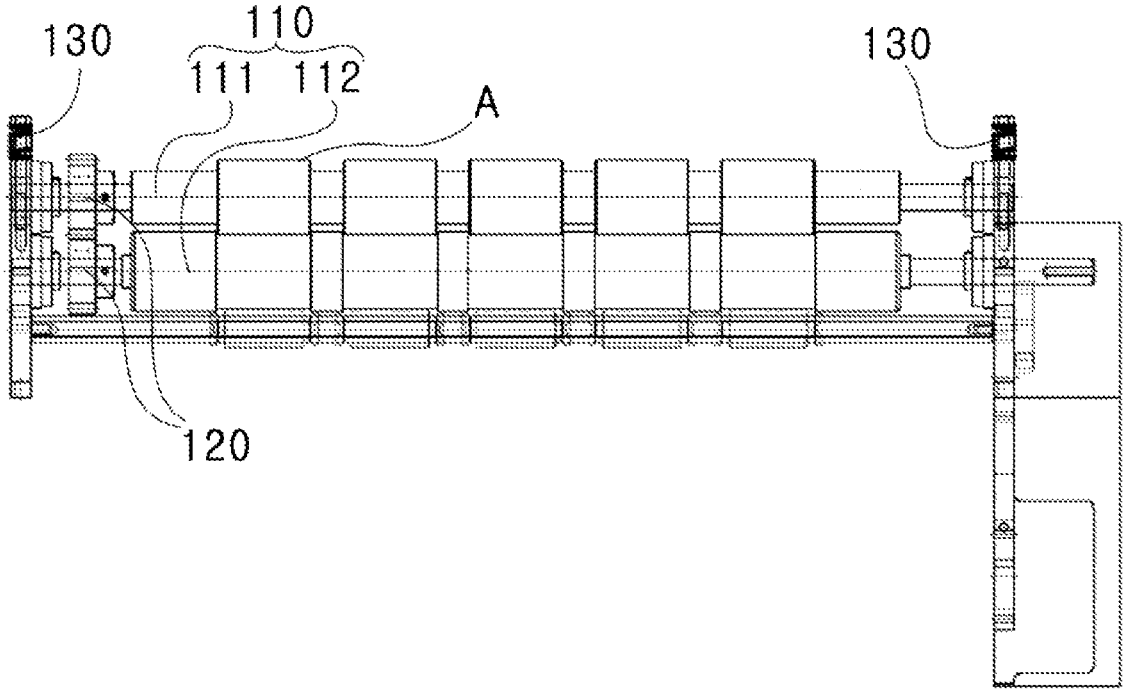
FIG. 4 is a structure view showing a cosmetic cotton fabric guide roller according to an embodiment of the present disclosure.

To this end, referring to FIG. 4, the cosmetic cotton supply unit 1 includes a cosmetic cotton fabric guide roller 110 supplying the longitudinally cut cosmetic cotton fabric (not shown) by a predetermined length. At this point, the cosmetic cotton fabric guide roller 110 includes a first guide roller 111 and a second guide roller 112 that grip the longitudinally cut cosmetic cotton fabric (not shown) from the both sides and supply the fabric by a predetermined length. The first guide roller 111 and the second guide roller 112 have respective rotation shafts thereof that are connected to each other through a separate second rotational interlock device 120, and the first guide roller 111 and the second guide roller 112 are rotated equally in conjunction with each other. Furthermore, the second guide roller 112 is fixed, but the first guide roller 111 is pressurized by a separate second elastic pressure member 130 and is moved, so that the first and second guide rollers are characterized to variably respond to the thickness of the longitudinally cut cosmetic cotton fabric (not shown) transported and to stably supply the longitudinally cut cosmetic cotton fabric (not shown) by a predetermined length.

The cosmetic cotton fabric guide roller 110 is configured to supply the longitudinally cut cosmetic cotton fabric (not shown) to the cosmetic cotton pad transverse cutting part, which is a follow process, by a predetermined length in the transport process. More specifically, the cosmetic cotton fabric guide roller 110 has the structure including the first guide roller 111 and the second guide roller 112 that supply the longitudinally cut cosmetic cotton fabric (not shown) by a predetermined length while gripping the fabric from the both sides.

Meanwhile, the first guide roller 111 and the second guide roller 112 may have separate rubber coating layers A formed on the outer circumferential surfaces of the rollers to further stably grip the longitudinally cut cosmetic cotton fabric (not shown). At this point, the rubber coating layers A are configured to allow the cosmetic cotton fabric (not shown) in contact with the surfaces thereof to be further firmly gripped on the basis of the frictional force, etc. of the surfaces. The rubber coating layers A may use rubber material as the basic material, and may be made of a compound in which a functional additives, etc. reinforcing the frictional force, etc. is mixed to the basic material.

The second rotational interlock device 120 connects the rotation shaft of the first guide roller 111 to the rotation shaft of the second guide roller 112 that are operated as a pair, so that the pair of the first guide roller 111 and the second guide roller 112 are rotated equally in conjunction with each other. Accordingly, a rotation speed of the second guide roller 112 rotated while being connected to a separate driving part (not shown) and a rotation speed of the first guide roller 111 may match with each other in conjunction with each other, and the cosmetic cotton fabric (not shown) transported and supplied through the guide rollers can be supplied to the following process (the cosmetic cotton pad transverse cutting part) at a precise speed and by a predetermined length.

As an embodiment of the second rotational interlock device 120, a gear connection structure, etc. connecting the rotation shaft of the first guide roller 111 to the rotation shaft of the second guide roller 112 may be used. Otherwise, various configurations such as a timing belt, etc. may be used as long as it can allow connection between various rotation shafts and rotation thereof to match with each other.

The second elastic pressure member 130 is configured to pressurize the first guide roller 111 rotated in conjunction with the second guide roller 112 in comparison to the fixed second guide roller 112. As described above, when the cosmetic cotton fabric (not shown) having a consistently constant thickness is supplied, there is no large problem, but it is difficult for the cosmetic cotton fabric (not shown) to have a consistently uniform thickness throughout the entire fabric. Specifically, in the case where one cosmetic cotton fabric ends and another cosmetic cotton fabric is subsequently connected thereto and transported (normally, in this case, the thickness may double at a portion in which one fabric is connected to another fabric), etc., a problem in that efficient transport and supply of the cosmetic cotton fabric (not shown) cannot be performed under the existing structure occurs, and the above problem can be solved when the configuration of the present disclosure can variably respond to the partially different thickness of the cosmetic cotton fabric. To solve the problem, the present disclosure has the structure in which the second guide roller 112 is fixed but the first guide roller 111 is pressurized by the second elastic pressure member 130, so that the present disclosure can variably respond to the thickness of the supplied cosmetic cotton fabric (not shown) and allow the fabric supply process supplying the longitudinally cut cosmetic cotton fabric (not shown) by a predetermined length, to be stably performed. As the second elastic pressure member 130, various configurations such as elastic springs, etc. that can exert an elastic force may be used.

The second elastic pressure member 130 also includes a separate elastic adjustment means (not shown) adjusting the elastic force and the elastic adjustment means can allow the second elastic pressure member 130 to adjust the elastic force thereof according to use environment and be used. In other words, fundamentally, when a double layer cosmetic cotton fabric is used and when a triple layer cosmetic cotton fabric is used, an appropriate process response is possible when a setting value for the basic elastic force of the second elastic pressure member 130 is changed. Accordingly, the elastic force of the second elastic pressure member 130 is controlled and adjusted through the elastic adjustment means according to a change of use environment as described above to actively respond to various use environmental changes, etc., to allow equipment use to widen the equipment utilization.

Furthermore, in addition, according to the present disclosure, a problem occurring from the packaging film supply unit 3, in other words, even though each cut cosmetic cotton fabric pad 200 should be precisely located within the packaging films 300 and a following process should be performed thereto, a problem that it is difficult for the stability of the packaging film process to be improved due to a defective rate caused by the difficulty in precisely locating each cosmetic cotton fabric pad 200 in a correct position in the slippery packaging films 300 is also improved, which will be described in detail below.

Figure 5:
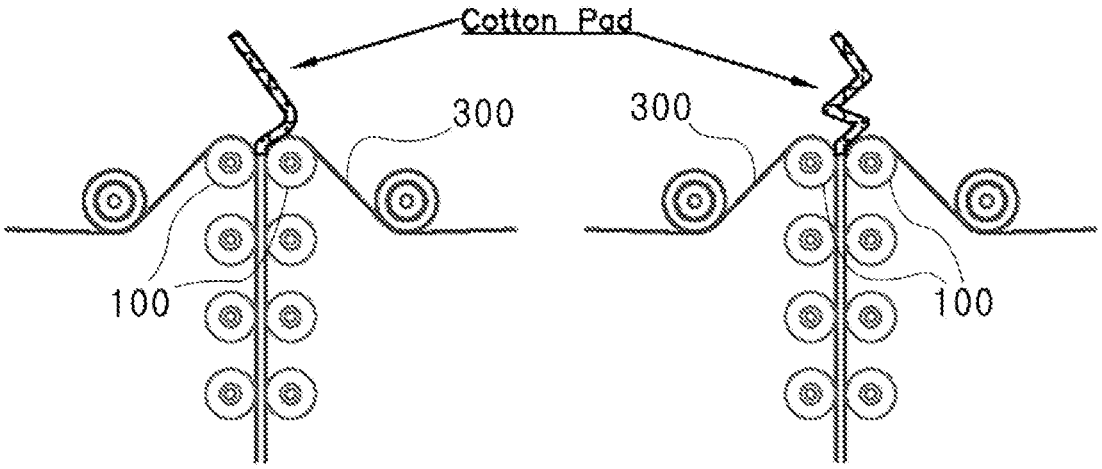
FIG. 5 is a view showing a conventional state in which a second end of a cosmetic cotton fabric is not firmly gripped in a packaging film.
Figure 6:
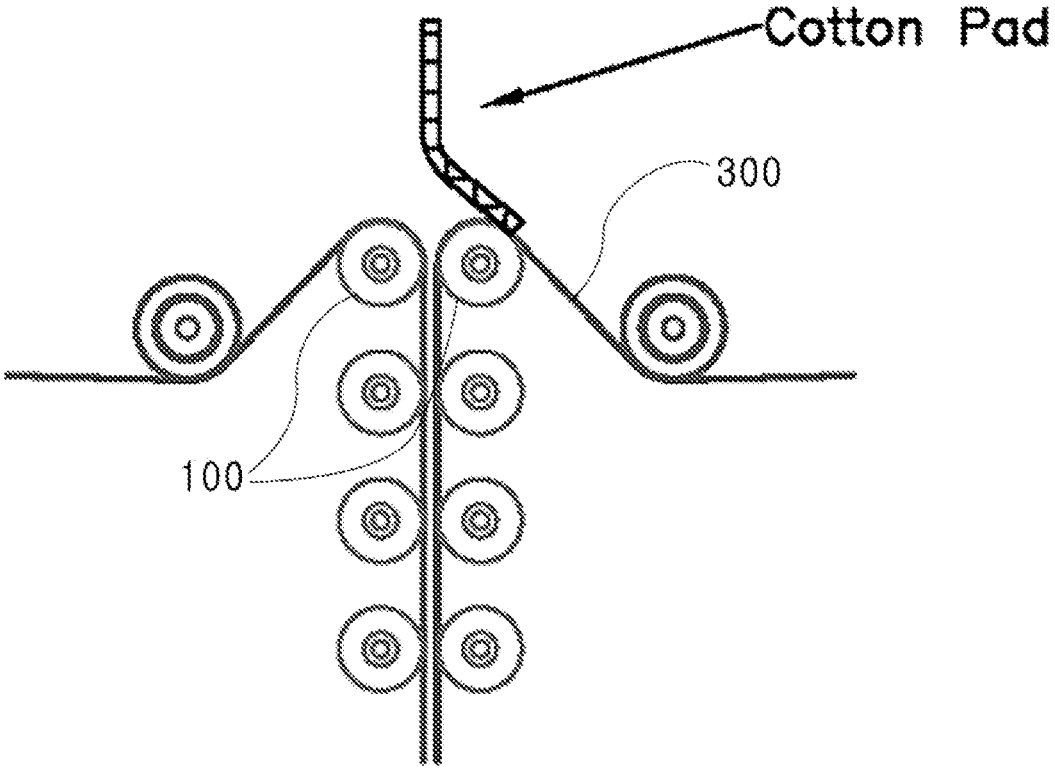
FIG. 6 is a view showing a conventional state in which a second end of a cosmetic cotton fabric slips on a packaging film.
Figure 7:
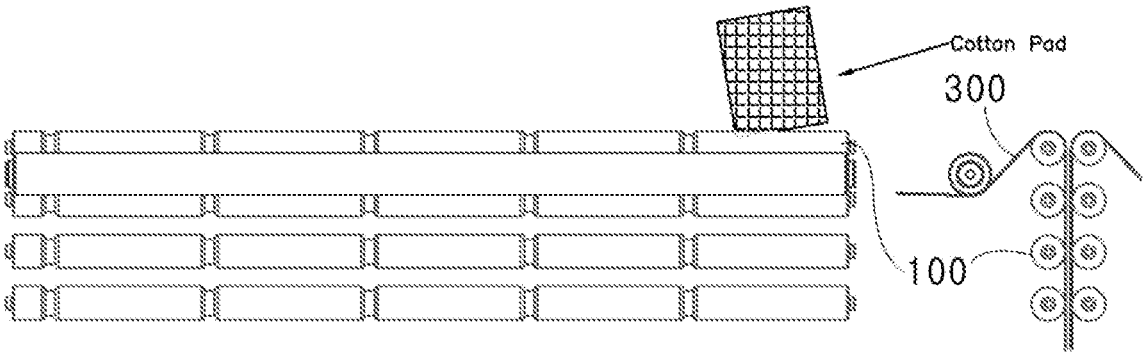
FIG. 7 is a view showing a conventional state in which a cosmetic cotton fabric pad is inserted crookedly into the packaging film.

First, in a structure (connection relationship) of a portion where the existing cosmetic cotton supply unit and the existing packaging film supply unit, in a state in which an end portion of the longitudinally cut cosmetic cotton fabric is held by packaging film supply transport rollers 100 guiding the packaging films supplied from the opposite sides to package the fabric (in other words, a state in which an end of the longitudinally cut cosmetic cotton fabric is held by the opposite packaging films) (referring to FIG. 5), a transverse cutting is performed for the cosmetic cotton fabric, and at this point, because surfaces of the packaging films 300 are slippery due to the nature of the packaging films 300, it is difficult for the opposite packaging films 300 to firmly hold an end of the longitudinally cut cosmetic cotton fabric, as shown in FIG. 5, a problem that inserting the end portion of the longitudinally cut cosmetic cotton fabric into the opposite packaging films 300 is not precisely performed occurs. To make matters worse, even when the opposite packaging films 300 hold the end portion of the longitudinally cut cosmetic cotton fabric at first, in the process in which transverse cutting is performed for the cosmetic cotton fabric, the cosmetic cotton fabric slides again by the force of the cutting and the cosmetic cotton fabric is separated from the opposite packaging films 300 as shown in FIG. 6 or is crookedly inserted into the opposite packaging films 300 as shown in FIG. 7, which is a problem. Specifically, these problems are caused, by not only an aspect generated by the difficulty for the slippery packaging films 300 to firmly hold the end portion of the longitudinally cut cosmetic cotton fabric, but also the slip amount generated by a difference of the thickness of the cosmetic cotton fabric partially different, and the existing device has a limitation that it is difficult to appropriately respond to these problems.

The present disclosure is intended to propose a new structure of the packaging film supply unit that solves the problem caused when the packaging films 300 directly grip the end portion of the cosmetic cotton fabric and the problem caused when the partially different thickness of the cosmetic cotton fabric should be appropriately responded, which will be described in detail below.

Figure 9:
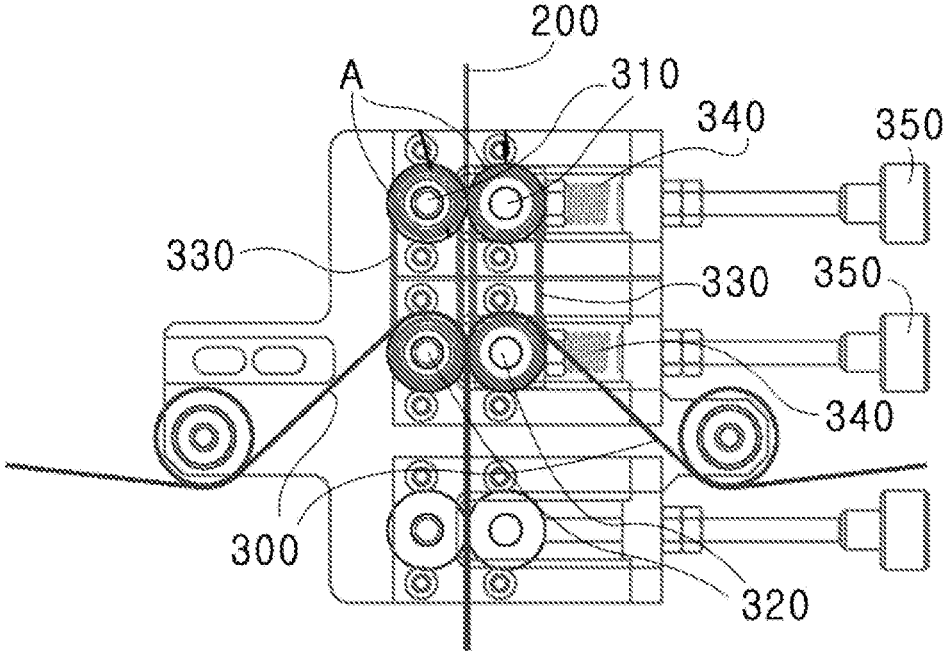
FIG. 9 is a structure view showing fabric pad supply rollers and packaging film supply rollers according to the embodiment of the present disclosure.

According to the present disclosure, as shown in FIG. 9, it is characterized in that the packaging film supply unit 3 includes a pair of packaging film supply rollers 320 supplying the pair of packaging films 300 from the opposite sides to package the cut cosmetic cotton fabric pad 200 at the opposite surfaces thereof, and a pair of the fabric pad supply rollers 310 gripping the cosmetic cotton fabric pad 200 cut (to be cut) at a front end of the pair of packaging film supply rollers 320, at the opposite sides and transporting the cosmetic cotton fabric pad 200 so that the cosmetic cotton fabric pad 200 is supplied into the pair of packaging films 300. At this point, the pair of packaging film supply rollers 320 is rotated in conjunction with a supply speed of the supplied pair of packaging films 300, and the pair of packaging film supply rollers 320 and the pair of the fabric pad supply rollers 310 located at the front end thereof are connected to each other through a separate rotational interlock device 330 and the pair of the fabric pad supply rollers 310 is rotated equally in conjunction with a rotation speed of the pair of packaging film supply rollers 320, so that the supplied cosmetic cotton fabric pad 200 is supplied into the packaging films 300 at an appropriate speed.

Figure 8:
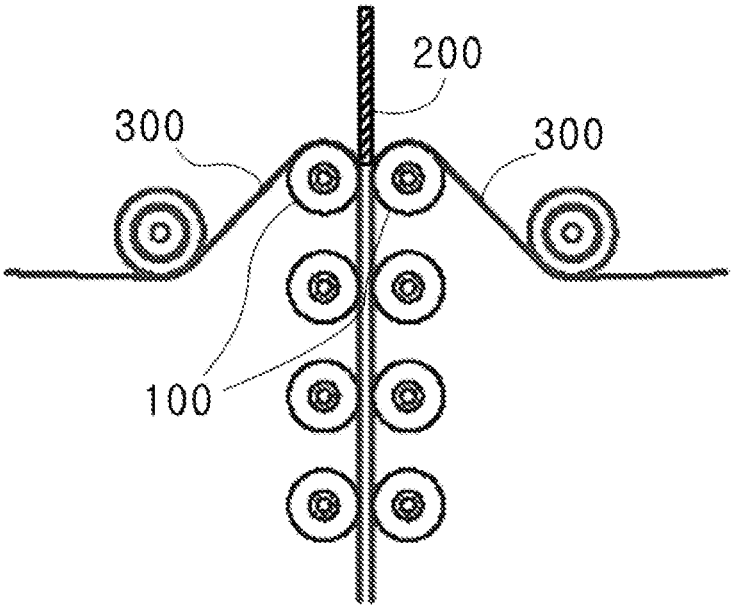
FIG. 8 is a structure view showing conventional packaging film supply transport rollers.

First, referring to FIG. 8, the existing structure uses the structure in which the packaging films 300 for packaging the cosmetic cotton fabric pad primarily perform direct grip for the end portion of the end portion of the longitudinally cut cosmetic cotton fabric, so it is difficult to firmly grip the end portion of the cosmetic cotton fabric because the surfaces of the packaging films 300 are slippery due to the nature of the packaging films 300. Accordingly, as described above, there may be the problems such that the end portion of the longitudinally cut cosmetic cotton fabric is not precisely inserted into the opposite packaging films 300, or in the process of transversely cutting the cosmetic cotton fabric, the cosmetic cotton fabric slips by the force and is separated from the opposite packaging films 300 or is crookedly inserted into the opposite packaging films 300. In order to fundamentally solve the problems, in the present disclosure, the pair of the separate fabric pad supply rollers 310 firmly grips the end portion of the longitudinally cut cosmetic cotton fabric primarily at front of the pair of packaging film supply rollers 320 to be described below, and at this point, rotation of the pair of the fabric pad supply rollers 310 and rotation of the pair of packaging film supply rollers 320 match with each other precisely, so that the supplied cosmetic cotton fabric pad 200 may be supplied into the packaging films 300 at a precise speed and a constant interval.

The pair of the fabric pad supply rollers 310 is configured to grip the cosmetic cotton fabric pad 200 cut (to be cut) at front of the pair of packaging film supply rollers 320 at the opposite sides to transport the cosmetic cotton fabric pad 200 so that the cosmetic cotton fabric pad 200 is supplied into the pair of packaging films 300. As described above, breaking away from the existing structure where the pair of packaging film supply rollers to be described primarily grips the cosmetic cotton fabric pad 200 directly, the pair of the separate fabric pad supply rollers 310 located at front of the pair of packaging film supply rollers 320 is provided newly to grip the cosmetic cotton fabric pad 200 at the opposite sides, so that the problem caused when the slippery packaging films grip the cosmetic cotton fabric pad directly. In other words, primarily, with the pair of the fabric pad supply rollers 310 firmly gripping the end portion of the longitudinally cut cosmetic cotton fabric, when the transverse cutting is performed for the cosmetic cotton fabric while the longitudinally cut cosmetic cotton fabric is firmly gripped, even in the cutting process, the cosmetic cotton fabric (after cutting, which becomes the cosmetic cotton fabric pad) does not slip or is not separated, and also, the cut cosmetic cotton fabric pad 200 is supplied into the pair of packaging films 300 in the pair of packaging film supply rollers 320 to be described below, while being firmly gripped, so that the cosmetic cotton fabric pad 200 may be precisely inserted into the packaging films 300.

To allow the pair of the fabric pad supply rollers 310 to further stably firmly grip the supplied cosmetic cotton fabric pad 200, separate rubber coating layers A may be formed on external circumferential surfaces of the fabric pad supply rollers 310.

The rubber coating layers A are configured to further firmly grip the cosmetic cotton fabric pad 200 in contact with surfaces thereof on the basis of a friction force of the surfaces thereof, and are made of rubber material as basic material, and may be made of a compound in which a functional additive, etc. reinforcing the friction force, etc. is mixed to the basic material.

The pair of packaging film supply rollers 320 is configured to supply the pair of packaging films 300 from the opposite sides to package the cut cosmetic cotton fabric pad 200 at the opposite surfaces thereof (if necessary, separate rubber coating layers may be formed on external circumferential surfaces of the packaging film supply rollers 320), and each roller of the pair of packaging film supply rollers 320 guides the packaging films 300 supplied from the opposite sides to contain the cut cosmetic cotton fabric pad 200 within the packaging films 300 and the cosmetic cotton fabric pad 200 is packaged with the packaging films 300 at front and rear surfaces thereof. Meanwhile, the pair of packaging film supply rollers 320 is rotated in conjunction with a rotation speed of the pair of packaging films 300, and at this point, it is important to match the rotation speed of the pair of packaging film supply rollers 320 and the rotation speed of the pair of the fabric pad supply rollers 310 located at front of the packaging film supply rollers. To this end, the rotational interlock device 330 to be described below is required.

The rotational interlock device 330 connects rotation shafts of the pair of packaging film supply rollers 320 to rotation shafts of the pair of the fabric pad supply rollers 310 located at front of the pair of packaging film supply rollers 320, thereby allowing the pair of the fabric pad supply rollers 310 to be rotated equally in conjunction with the rotation speed of the pair of packaging film supply rollers 320. Accordingly, eventually, a supply speed of the pair of packaging films 300 and the rotation speed of the pair of packaging film supply rollers 320 and the rotation speed of the pair of the fabric pad supply rollers 310 match with each other while being operated in conjunction with each other, so that the supplied cosmetic cotton fabric pad 200 may be supplied into the packaging films 300 at a precise speed and a constant interval.

As an embodiment of the rotational interlock device 330, a timing belt may be used to connect the rotation shafts of the pair of packaging film supply rollers 320 to the rotation shafts of the pair of the fabric pad supply rollers 310 located at front of the pair of packaging film supply rollers 320. Otherwise, various configurations can be used as long as it can connect the various rotation shafts to each other and match rotations of the various rotation shafts.

Meanwhile, as described above, the thickness of the supplied cosmetic cotton fabric is not always uniform, and therefore, only when the present disclosure can variably respond even to the partially different thickness of the cosmetic cotton fabric, it is possible to solve the problem that the cosmetic cotton fabric pad is crookedly inserted into the packaging film, which is caused by the difference in the slip amount caused by the difference in the partially different thickness of the cosmetic cotton fabric, as described above. To solve the problems, according to the present disclosure, the pair of the fabric pad supply rollers 310 and the pair of packaging film supply rollers 320 have respective structures in which one roller is fixed but the other roller is pressurized by a separate elastic pressure member 340, thereby variably responding to the thickness of the supplied cosmetic cotton fabric pad 200 and allow the packaging film process to be stably performed. As an example, as shown in FIG. 9, in the pair of the fabric pad supply rollers 310 and the pair of packaging film supply rollers 320, rollers located at the left side are fixed, but rollers located at the right side use a structure variably pressurized by the separate elastic pressure member 340. Accordingly, the rollers can firmly grip and transport the cosmetic cotton fabric pad 200 and locate the cosmetic cotton fabric pad 200 at precise location and interval within the packaging films 300 even when the thickness of the supplied cosmetic cotton fabric pad 200 is variably changed.

The elastic pressure member 340 exerts an elastic force to pressurize one roller of the pair of the fabric pad supply rollers 310 and one roller of the pair of packaging film supply rollers 320, and various configurations such as an elastic spring, etc. that exerts an elastic force may be used.

As shown in FIG. 9, one portion of the elastic pressure member 340 includes an elastic adjustment means 350 adjusting the elastic force of the elastic pressure member 340, thereby adjusting and using the elastic force of the elastic pressure member 340 according to use environment. In other words, fundamentally, when a double layer cosmetic cotton fabric is used and when a triple layer cosmetic cotton fabric is used, an appropriate process response is possible when a setting value for the basic elastic force of the elastic pressure member 340 is changed. Accordingly, the elastic force of the elastic pressure member 340 is controlled and adjusted through the elastic adjustment means 350 according to a change of use environment as described above to actively respond to various use environmental changes, etc., to allow equipment use to widen the equipment utilization.

Furthermore, in the existing process of finally cutting the pouch pile with the cut cosmetic cotton fabric pads arranged within the packaging films and producing individual pouches, when vertical (longitudinal) cutting the pouch pile, the pouch pile may be moved or lean to one side and uneven cutting of left and right portions occurs. This problem occurs also in horizontal (transverse) cutting, resulting degradation in efficiency of the entire packaging process and degradation in quality of final products (pouches). Therefore, the present disclosure also proposes a new structure (configuration) that can solve this problem.

In other words, the packaging film supply unit 3 includes separate press guide rollers (not shown), and before cutting a pouch pile in which the cut cosmetic cotton fabric pad 200 is arranged within the packaging films 300, the press guide rollers grip and align the pouch pile. Therefore, the existing problem in that when the pouch pile is vertically (longitudinally) cut or horizontally (longitudinally) cut, the pouch pile is moved or leans to one side and the left portion and the right portion of the pouch pile are cut unevenly is solved.

The press guide rollers (not shown) grip (concept that prevents slip by a kind of pressure) and align the pouch pile at a timing when cutting is performed, in a process in which the pouch pile with the cut cosmetic cotton fabric pad 200 being arranged within the packaging films 300 is transported to a following cutting process, and may be formed in a form located at one side of the pouch pile and pressurizing the pouch pile.

The press guide rollers (not shown) may include separate rubber coating layers formed on external circumferential surfaces thereof to stably grip and align the pouch pile. The rubber coating layers may have the same configuration as the rubber coating layers described above, and on the basis of the friction force of surfaces thereof, the press guide rollers further firmly grip the pouch pile in contact with the surfaces, and use rubber material as the basic material, and a compound in which a functional addictive is mixed in the basic material to reinforce the friction force may be used.

Furthermore, in addition, the present disclosure is specifically configured to solve a problem occurring in a process of transporting final produced pouches (not shown). In other words, when the packaging film cutting part finishes the longitudinal cutting and transverse cutting to a pouch pile in which a plurality of cosmetic cotton fabric pads 200 is sealed inside the packaging films 300 at predetermined intervals and then respective pouches (not shown), the final products, are produced, the pouches (not shown) produced after the cutting fall onto the transport conveyor and are arranged in a disorderly manner on the transport conveyor to be transported. Therefore, counting the final produced pouches is not precisely and rapidly performed and following processes such as a final packaging process for the pouches are delayed, which are problems, so the present disclosure focuses on improving the problems, which will be described below.

In order to improve the above-described problems caused when the final produced pouches are not located in correct positions and aligned on the transport conveyor, the present disclosure uses and proposes a new separate structure that separately sucks the final cut pouches and then correctly places and aligns the pouches on the transport conveyor.

Figure 10:
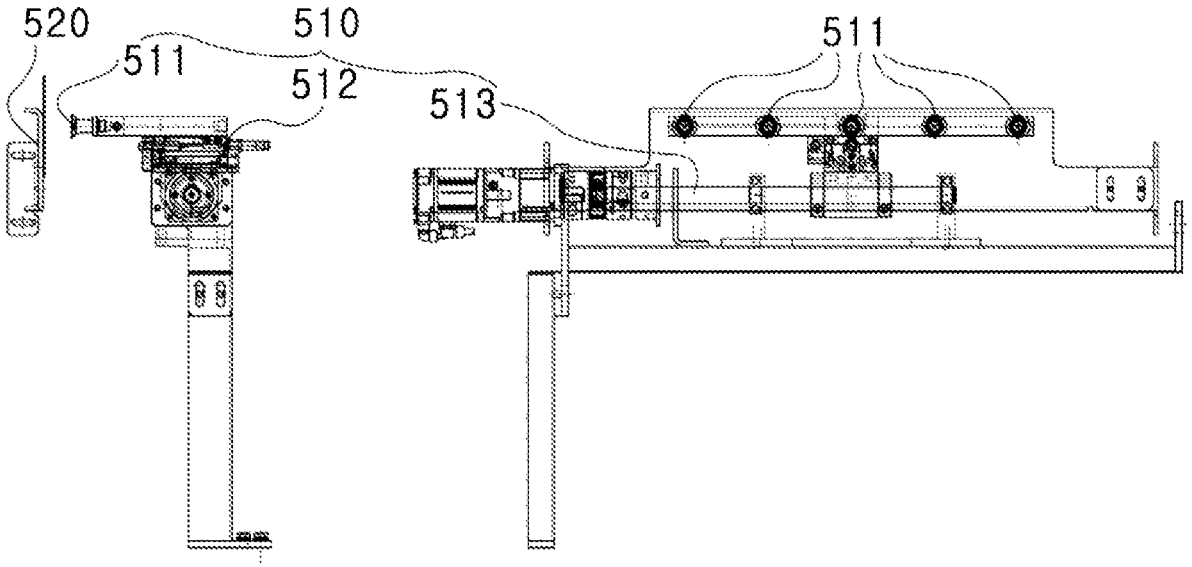
FIG. 10 is a structure view showing a rotation suction part and a suction guide part according to the embodiment of the present disclosure.

To this end, referring to FIG. 10, the pouch alignment unit 5 may include a rotation suction part 510 sucking a cut pouch (not shown) and rotated to place and align the cut pouch in a correct position on the transport conveyor, and a suction guide part 520 allowing the rotation suction part 510 to easily suck the pouch the pouch (not shown).

The suction guide part 520 allows the rotation suction part 510 (a plurality of suction pads 511) to easily suck a pouch (not shown). More specifically, as shown in FIG. 10, in order to allow the plurality of suction pads 511 of the rotation suction part 510 to be described below to precisely suck respective pouches (not shown) on the pouch pile, the suction guide part 520 serves as a support that supports the pouch pile behind the pouch pile to prevent the pouch pile from being pushed in the suction process. Accordingly, based on a support force provided by the suction guide part 520, the rotation suction part 510 (the plurality of suction pads 511) can easily suck the pouches (not shown).

The rotation suction part 510 sucks a pouch (not shown) to be cut (preferably, suction by the rotation suction part 510 and transverse cutting of the pouch pile are performed almost at the same time) and then is rotated to place and align the pouch in a correct position on the transport conveyor. Accordingly, the rotation suction part 510, more specifically, includes the plurality of suction pads 511 respectively sucking and gripping a plurality of pouches (not shown) to be cut, a vacuum generator (not shown) generating vacuum required for suction of the respective suction pads 511, a suction pad driving part 512 moving the plurality of suction pads 511 forwards and rearwards, a rotation shaft 513 rotating the plurality of suction pads 511 between the suction guide part 520 and the transport conveyor, and a control part (not shown) controlling the plurality of suction pads 511 to be located at precise points.

The plurality of suction pads 511 respectively sucks and grips the plurality of pouches (not shown) generated by being cut from the pouch pile. Normally, it is preferable that the number of the plurality of suction pads 511 is provided corresponding to the number of the pouches (not shown) generated transversely in one row from the pouch pile.

The vacuum generator generates vacuum required for suction of the plurality of suction pads 511 for the respective suction pads 511, and the vacuum generator allows each suction pad 511 to generate a suction force required for sucking each pouch (not shown).

The suction pad driving part 512 is a driving part that moves the plurality of suction pads 511 forwards and rearwards as necessary. In order to allow the plurality of suction pads 511 to suck the plurality of pouches (not shown) located on the pouch pile, the suction pad driving part 512 moves the plurality of suction pads 511 forwards to bring the plurality of suction pads 511 in close contact with the pouches (not shown). After the suction, the suction pad driving part 512 moves the plurality of suction pads 511 rearwards to rotate the plurality of suction pads 511 toward the transport conveyor, at this point, when vacuum generated in each of the suction pads 511 is removed, the suction force is lost to allow the pouches (not shown) attached to the suction pads 511 to be placed on the transport conveyor. Thereafter, the plurality of suction pads 511 is rotated again in the opposite direction and faces pouches (not shown) of the next pouch pile to be attached, as before. Various configurations such as cylinders capable of being moved forwards and rearwards are used as the suction pad driving part 512.

The rotation shaft 513 is a central shaft of rotation to rotate the plurality of suction pads 511 between the suction guide part 520 and the transport conveyor.

The control part controls the plurality of rotated suction pads 511 to be located at the precise positions. Primarily, the control part serves to control a rotation angle, speed, etc. of the plurality of rotated suction pads 511 (normally, which may be realized by control of location/movement to a servomotor). Moreover, the control part may variably control a stacking form of the pouches (not shown) stacked on the transport conveyor. Furthermore, the control part provides a function that can precisely count the number of the generated pouches (not shown). To this end, the control part, more specifically, includes a counting module (not shown) counting the number of the pouches that are stacked on the transport conveyor through the plurality of rotated suction pads 511, a rotation interval control module (not shown) controlling rotation intervals of the plurality of rotated suction pads 511, and a transport speed control module (not shown) controlling a transport speed of the transport conveyor that is moved in one direction, so that the control part is characterized to variably control a stacking form of the pouches (not shown) stacked on the transport conveyor and precisely count the number of the pouches.

The counting module serve to count the number of the pouches stacked on the transport conveyor through the plurality of suction pads 511. The counting module may use a method that counts the number of the plurality of suction pads 511, the number of operations (rotations) of the plurality of suction pads 511, etc. to count production of the pouches (not shown) produced at a specific point in time.

The rotation interval control module serves to control rotation intervals of the plurality of rotated suction pads 511, and the transport speed control module serves to control a transport speed of the transport conveyor moved in one direction. As described above, when the rotation intervals of the plurality of suction pads 511 and the transport speed of the transport conveyor are controlled, the stacking form, which is how the pouches (not shown) will be stacked on the transport conveyor, may be variably controlled. As an example, in a state where the transport conveyor is not moved at all for a certain period of time, when rotations of the plurality of suction pads 511 are performed 5 times, the pouches (not shown) may be placed on the transport conveyor while being stacked in 5 layers. On the other hand, the faster the transport of the transport conveyor is controlled, the more pouches (not shown) placed on the transport conveyor may be transported in a stacked form with little or no overlap. Through the configuration and function of the control part as described above, the present disclosure can variably control the stacking form of the pouches (not shown) loaded on the transport conveyor and precisely count the number of the pouches.

Hereinabove, the applicant has described various embodiments of the present disclosure, but the embodiments are only embodiments that realize the technical spirit of the present disclosure, and it should be interpreted that any changes or modifications are included within the scope of the present disclosure as long as they realize the technical spirit of the present disclosure.

The invention claimed is:

1. A packaging device for an individual pouch-packaged pad-type cosmetic product, the packaging device comprising:

a cosmetic cotton supply unit supplying a cosmetic cotton pad to be contained within a packaging film;

a packaging film supply unit supplying a packaging film to package a cut cosmetic cotton fabric pad;

and a pouch alignment unit placing and aligning a cut pouch in a correct position thereof on a transport conveyor, wherein the cosmetic cotton supply unit comprises a cosmetic cotton fabric guide roller supplying a longitudinally cut cosmetic cotton fabric by a predetermined length, and the cosmetic cotton fabric guide roller comprises a first guide roller and a second guide roller, which grip the longitudinal cut cosmetic cotton fabric from the opposite sides and supply the cosmetic cotton fabric by the predetermined length, wherein the second guide roller is connected to a separate driving part to be rotated at a predetermined rotation speed, and the first guide roller is connected to the second guide roller through a second rotational interlock device, and the first guide roller is operated in conjunction with the rotation speed of the second guide roller to be rotated equally to enable the longitudinally cut cosmetic cotton fabric transported to be supplied at a precise speed, and wherein the second guide roller is fixed, but the first guide roller has a structure that is moved while being pressurized by a separate second elastic pressure member, thereby stably supplying the longitudinally cut cosmetic cotton fabric by the predetermined length while variably responding to a thickness of the longitudinally cut cosmetic cotton fabric transported.

2. The packaging device of claim 1, wherein the packaging film supply unit comprises a pair of packaging film supply rollers supplying a pair of packaging films from the opposite sides to package the cut cosmetic cotton fabric pad at the opposite surfaces thereof, and a pair of fabric pad supply rollers gripping the cosmetic cotton fabric pad from the opposite sides thereof cut at front of the pair of packaging film supply rollers and supplying the cut cosmetic cotton fabric pad into the pair of packaging films.

3. The packaging device of claim 2, wherein the pair of packaging film supply rollers is rotated in conjunction with a supply speed of the pair of packaging films supplied, and the pair of packaging film supply rollers and the pair of fabric pad supply rollers located at front of the pair of packaging film supply rollers are connected to each other by a rotational interlock device, and the pair of fabric pad supply rollers is rotated equally in conjunction with a rotation speed of the pair of packaging film supply rollers to supply the supplied cosmetic cotton fabric pad into the packaging films at a precise speed.

4. The packaging device of claim 1, wherein the pouch alignment unit comprises a rotation suction part sucking the cut pouch and then rotated to place and align the pouch in correct position thereof on the transport conveyor, and a suction guide part allowing the rotation suction part to suck the pouch easily.

5. The packaging device of claim 4, wherein the rotation suction part comprises a plurality of suction pads respectively sucking and gripping a plurality of cut pouches, a vacuum generator generating vacuum required for suction of the respective suction pads, a suction pad driving part moving the plurality of suction pads forwards and rearwards, a rotation shaft allowing the plurality of suction pads to be rotated between the suction guide part and the transport conveyor, and a control part controlling the plurality of rotated suction pads to be located in precise positions thereof.

6. The packaging device of claim 5, wherein the control part comprises a counting module counting the number of pouches stacked on the transport conveyor through the plurality of rotated suction pads, a rotation interval control module controlling rotation intervals between the plurality of rotated suction pads, and a transport speed control module controlling a transport speed of the transport conveyor moved in one direction, thereby variably controlling a stacking form of the pouches stacked on the transport conveyor and precisely counting the number of the pouches.

7. A packaging device for an individual pouch-packaged pad-type cosmetic product, the packaging device comprising:

a cosmetic cotton supply unit supplying a cosmetic cotton pad to be contained within a packaging film;

a packaging film supply unit supplying a packaging film to package a cut cosmetic cotton fabric pad;

and a pouch alignment unit placing and aligning a cut pouch in a correct position thereof on a transport conveyor, wherein the cosmetic cotton supply unit comprises a cosmetic cotton fabric guide roller supplying a longitudinally cut cosmetic cotton fabric by a predetermined length, and the cosmetic cotton fabric guide roller comprises a first guide roller and a second guide roller, which grip the longitudinal cut cosmetic cotton fabric from the opposite sides and supply the cosmetic cotton fabric by the predetermined length, wherein the packaging film supply unit comprises a pair of packaging film supply rollers supplying a pair of packaging films from the opposite sides to package the cut cosmetic cotton fabric pad at the opposite surfaces thereof, and a pair of fabric pad supply rollers gripping the cosmetic cotton fabric pad from the opposite sides thereof cut at front of the pair of packaging film supply rollers and supplying the cut cosmetic cotton fabric pad into the pair of packaging films, wherein the pair of packaging film supply rollers is rotated in conjunction with a supply speed of the pair of packaging films supplied, and the pair of packaging film supply rollers and the pair of fabric pad supply rollers located at front of the pair of packaging film supply rollers are connected to each other by a rotational interlock device, and the pair of fabric pad supply rollers is rotated equally in conjunction with a rotation speed of the pair of packaging film supply rollers to supply the supplied cosmetic cotton fabric pad into the packaging films at a precise speed, and wherein the pair of fabric pad supply rollers and the pair of packaging film supply rollers have structures, in which one roller is fixed but the other roller is pressurized by a separate elastic pressure member, thereby stably performing a packaging film process while variably responding to a thickness of the cosmetic cotton fabric pad supplied.

8. The packaging device of claim 7, wherein the packaging film supply unit further comprises press guide rollers gripping and aligning a pouch pile before the pouch pile with the cut cosmetic cotton fabric pad being arranged within the packaging films is cut, and each of the press guide rollers has a separate rubber coating layer formed on an external circumferential surface thereof to stably grip and align the pouch pile.

* * * * *